US005889871A

United States Patent [19]

Downs, Jr.

[11] Patent Number: 5,889,871

[45] Date of Patent: Mar. 30, 1999

[54] SURFACE-LAMINATED PIEZOELECTRIC-FILM SOUND TRANSDUCER

[75] Inventor: Edward F. Downs, Jr., Lynn Haven, Fla.

[73] Assignee: The United States of America as represented by the Secretary of the Navy, Washington, D.C.

[21] Appl. No.: 136,856

[22] Filed: Oct. 18, 1993

[51] Int. Cl.[6] ..... H04R 25/00

[52] U.S. Cl. ..... 381/173; 381/190

[58] Field of Search ..... 381/173, 190; 310/328, 332, 340, 327

[56] References Cited

U.S. PATENT DOCUMENTS

| | | | |
|---|---|---|---|
| 3,941,932 | 3/1976 | D'Hoogh | 381/190 |
| 4,013,992 | 3/1977 | Dewberry et al. | 367/161 |
| 4,045,695 | 8/1977 | Itagaki et al. | 310/322 |
| 4,156,800 | 5/1979 | Sear et al. | 179/110 A |
| 4,302,633 | 11/1981 | Tamamura et al. . | |
| 4,535,205 | 8/1985 | Ravinet et al. | 179/110 A |
| 4,677,336 | 6/1987 | Kushida et al. | 310/334 |
| 4,747,192 | 5/1988 | Rokurota | 29/25.35 |
| 4,833,659 | 5/1989 | Geil et al. | 367/155 |
| 5,210,455 | 5/1993 | Takeuchi et al. | 310/328 |

OTHER PUBLICATIONS

1989 Article from Puget Sound Business Review entitled "Whale–sensing device torjpedoed by Navy".

1989 Article by Michael E. Sofen entitled "Technology Innovators need not Apply".

Sea Acoustics Ltd 1987 Product Brochure for Models 115. CX and 109. CX Hydrophones.

*Primary Examiner*—Sinh Tran

*Attorney, Agent, or Firm*—Kenneth W. Dobyns; Wm Cecil Townsend; Edward J. Connors, Jr.

[57] ABSTRACT

A sound transducer, which may be a microphone or a speaker, is constructed using a metallic film sandwich of piezoelectric film as the active element. The sandwich is laminated to a flat inflexible substrate, such as a printed circuit board, over substantially its entire surface area, so that it operates as a transducer without flexing the piezoelectric film. Since the piezoelectric film is less sensitive in this mode than when it flexes, either the area of the sandwich must be large, or, as a microphone, the transducer must be subject to powerful sound waves. Such powerful sound waves are most easily achieved by either putting the microphone in physical contact with the sound source or placing the microphone in a contained pressure-field with the sound source. This entire package is then provided with impedance matching to connect it to an external point where the resulting signal can be used, is provided with a ground shield, and is encased in waterproof layers.

10 Claims, 1 Drawing Sheet

SURFACE-LAMINATED PIEZOELECTRIC-FILM SOUND TRANSDUCER

GOVERNMENT INTEREST STATEMENT

The invention described herein may be manufactured and used by the Government of the United States of America for government purposes without the payment of any royalties thereon.

BACKGROUND OF THE INVENTION

Piezoelectric film has been used to make many different types of sensors. One type of sound transducer that can be made using this technology is a microphone. Such a microphone is frequently constructed in the prior art by stretching a film membrane tight between two or more attachment points, allowing the film membrane to serve as a moving diaphragm. Sound causes the film diaphragm to vibrate. The vibration of the film generates an electric voltage across the two surfaces of the film which is then amplified and fed into a communication system. One significant limitation of this type of microphone is that it cannot operate in harsh environments where water or water vapor is present. Placing a waterproof membrane over the face of the vibrating diaphragm drastically reduces and almost eliminates the sound reaching the diaphragm and resulting in vibration of the diaphragm.

Conventional use of piezoelectric film in microphones involves the film being stretched between points or across a ring to provide stress in the film. When sound strikes the film, the film vibrates. This mechanical vibratory motion is what causes the film to produce an oscillating voltage field between the two sides of the film. If the film is not stretched tight, it is less sensitive to sound pressure waves, and therefore the oscillating voltage field between the two sides of the film is significantly reduced. If the volume of the sound source is increased, or the sound source is moved closer to the piezoelectric film, the sound level striking the film is greater and therefore the signal emitted from the film is increased.

SUMMARY OF THE INVENTION

The present invention relates to a microphone constructed from a piezoelectric film. In the preferred embodiment it relates to a microphone using a polyvinylidene fluoride (PVDF) film with a membrane thickness of the order of 15 microns. Two thin conductive films are also used, one affixed to each opposite face of the PVDF film to form a PVDF sandwich element. Because there is no necessity of a vibrating diaphragm with the present invention, the PVDF sandwich element is preferably firmly affixed to a firm, flat, substantially non-vibrating substrate to form a mounted PVDF sandwich element. The resulting PVDF film device may be used as a microphone in two modes.

A first mode is use in a pressure-field environment where all sound pressure levels are equal regardless of where the measurement is taken. An example of this first mode is use inside an oral-nasal mask worn on the face of a person wearing a diving life-support breathing apparatus. A second mode is use in physical contact with some part of the face or head in order to pick up voice sounds and not pick up unwanted external noise. Additional modes of use are, of course, possible.

The membrane type of microphone cannot be environmentally sealed without using a water barrier that will dampen or eliminate the acoustic signal. A surface laminated microphone according to the present invention is a more rugged design that can function in any environmentally harsh environment and can be used as a contact microphone in contact with the face, picking up the voice while rejecting external sound. It can be molded into any shape, which allows it to be used anywhere, even inside the mouth.

With the present design, the sound striking the film is made intense enough by either placing the microphone in direct contact with the sound source, such as pressed against a speaker's forehead, or inside the same closed cavity with the sound source, such as inside an oral-nasal masks worn by the speaker. The sound levels in contact with the sound source or in such a closed cavity are much greater than in free space, such as an inch in front of the speaker's mount without a mask.

Sound measurement is divided into two areas—free field and pressure field. Free-field measurements are those made in open space. Examples of free-field measurements include measurement of machinery noise at a distance from the machinery, or measurement of aircraft noise inside an air terminal. Pressure-field measurements occur in areas where, no matter where you take the sample, the pressure level is substantially the same. One example of this is inside an oral-nasal face mask worn by a speaker. This microphone would preferably be used as a pressure-field microphone and works best in such environments.

Most, perhaps all or nearly all, of the previous work with piezoelectric film microphones has been done with free-field sound, where the sound level is low enough to require a twisting or torsional vibration of the piezoelectric film to achieve a resulting electric field large enough to achieve a sufficiently high signal-to-noise ratio for the microphone to be useful. But a microphone in which the piezoelectric film is mounted on a non-flexible substrate can achieve a resulting voltage field between the two conducting layers sandwiching the piezoelectric film large enough to be useful if (1) the microphone is in a pressure-field environment, (2) the piezoelectric film in the microphone is very large, or (3) the microphone is in direct contact with a sound source such as the head of a person who is speaking.

DESCRIPTION OF THE PREFERRED EMBODIMENT

Figure 1:
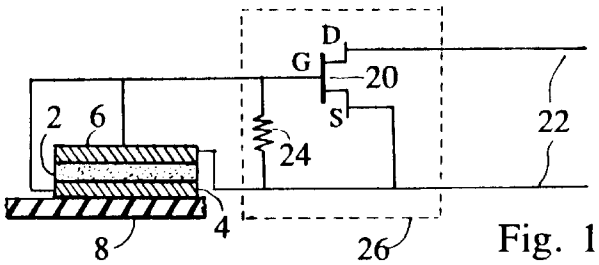
FIG. 1 is a partially schematic diagram of a mounted PVDF sandwich element connected through an impedance matching circuit to an output cable.

Referring to FIG. 1, a thin piezoelectric film 2, made for example of polyvinylidene fluoride (PVDF), is sandwiched between two conductive layers 4 and 6, which may be thin metallic films. This forms a piezoelectric sandwich element, or more specifically a PVDF sandwich element. The conductive film layers 4 and 6 coat the bottom and top surface of the piezoelectric film and are constructed from conductive material such as aluminum or nickel. Wires are attached to the top and bottom conductive layers using silver epoxy. The sandwich element is then firmly mounted or laminated on a solid, flat, substantially inflexible, substrate 8, which is preferably a piece of printed circuit board material.

The connecting connectors or wires connected to conductive layers 4 and 6 are connected to the inputs of an impedance matching circuit 26. Because of the high natural impedance of a piezoelectric sandwich, a 10 MΩ resistor 24 is connected across the inputs of circuit 26 and between the gate and source terminals of a JFET transistor 20. The source and drain terminals of transistor 20 are connected to the two twisted wires of a shielded, twisted wire cable 22, which both furnishes the DC operating power and carries off the resulting impedance-matched AC microphone output signal.

Figure 2:
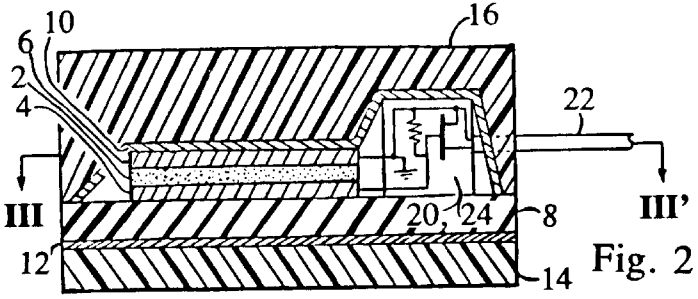
FIG. 2 is a cross-sectional diagram, partially schematic, of a microphone according to the present invention. The cross-section is taken along line II–II' indicated in FIG. 3.

Referring to the cross-sectional view shown in FIG. 2, the piezoelectric sandwich 2, 4, 6, is shown affixed to the circuit board 8, which forms the inflexible substrate. This sandwich has a square form of 0.75 inch by 0.75 inch in the preferred embodiment. This cross-sectional view is taken along the line II–II' shown in FIG. 3. A metal layer 12 forms the undersurface of the substrate, and in practice, all of the interconnection might be made through circuits etched into that metal layer. The wires which are connected by silver epoxy to metal layers 4 and 6 can be connected directly to circuits etched into metal layer 12. For ease of illustration, and because the precise structure of the interconnection circuits form no part of the invention, the impedance-matching interconnection circuits used to connect the PVDF sandwich and the twisted wire shield cable 22 are shown in schematic form only in the end view of the block containing JFET 20 and 10 MΩ resistor 24. This circuit matches that shown in FIG. 1. A ground shield 10 is preferably placed over the piezoelectric sandwich and the impedance matching circuit to allow use in an environment of high electromagnetic interference.

The surface of the film and circuit board is then covered with a hydrophobic epoxy in layers 14 and 16 to provide environmental protection against water intrusion that would short out the film destroying its ability to function. The necessity in harsh environmental conditions of providing such a water-resistant layer is a primary reason why diaphragm-based piezoelectric microphones will not work under the conditions for which the present invention is needed.

Figure 3:
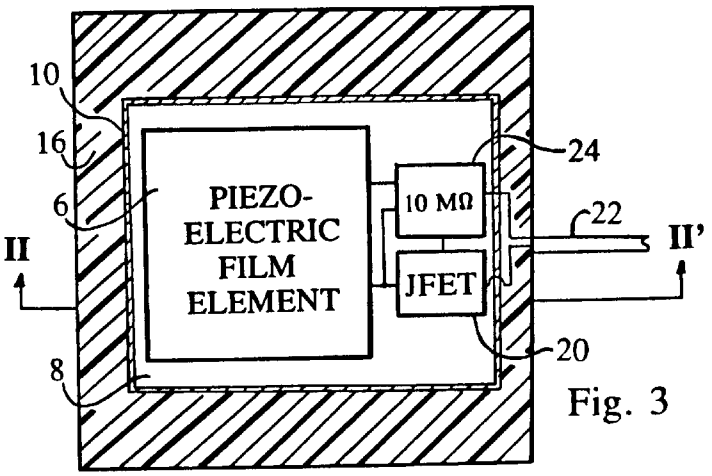
FIG. 3 is another cross sectional diagram, partially schematic, of a microphone according to the present invention. The cross-section is taken along line II–II' in FIG. 2.

FIG. 3 is another view of the same circuit shown in FIG. 2, taken along the line II–II' of FIG. 2. Elements and numbers correspond with those in FIG. 2.

Figure 4:
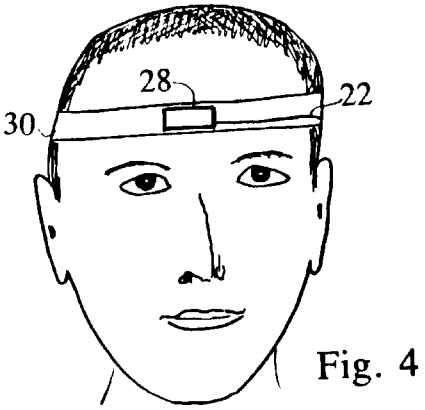
FIG. 4 is an illustration showing how the microphone may be positioned for use in direct contact with a person's head.
Figure 5:
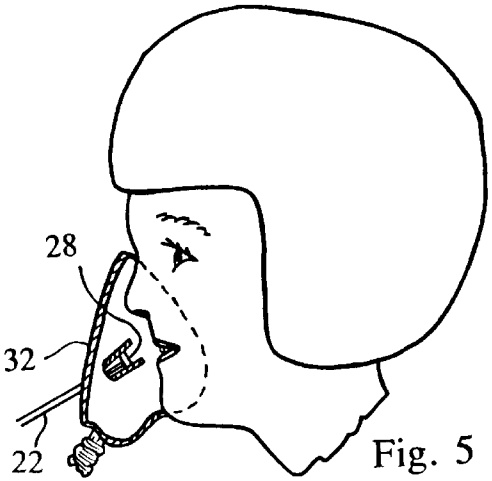
FIG. 5 is an illustration showing how the microphone may be position for use in the pressure-field environment present inside an oral-nasal mask, such as worn by fire-fighters, pilots, etc.

The microphone can function by picking up vibrations from a person's head when the microphone is in direct contact with the head. It can also be used directly in front of the person's mouth, as in an oral-nasal mask. The microphone can be molded into different shapes since it is a film and can be built into the head liner of a helmet, hat or sweat band. In FIG. 4, such a microphone 28 is shown held against a person's forehead by a sweatband 30. Preferably epoxy layer 14 is held in contact with the forehead. The twisted-pair cable 22 leads the resulting signal off to a point of use. In FIG. 5, a similar microphone 28 is shown positioned in the pressure-field environment inside an oral-nasal mask 32 (shown in cutaway), with cable 22 serving to conduct the resulting signal to some external point where it can be used.

Such a microphone is small, light weight and requires minimal power to operate. Its preamplifier is a small JFET transistor that serves as an impedance matcher. This offers the opportunity to interface the microphone directly with battery-powered radios, etc.

Good physical contact is needed between the microphone and the forehead. Some rubberized foam between the sweatband and the microphone can achieve the necessary compression to help achieve this good contact, or a flexible plastic bag of liquid or gel can be placed between the microphone and the forehead to conform to the forehead to achieve good sound transmission.

A layer of Velcro can be used on epoxy layer 16 to allow removable attachment of a microphone to a helmet liner.

Although FIG. 4 illustrates the microphone in use in contact with the forehead, contact with other parts of the body is also appropriate for sound transmission. Heartbeat monitoring is possible with the microphone in contact with the sternum. Contact with any part of the human body, or even that of another living being such as an animal, can be made for transmission of sound from that body.

It is also possible to place a resonantly tuned metal plate on the outside of epoxy layer 16 to greatly increase the response of the microphone to sound waves in a band of perhaps 1000 Hz, while decreasing the response to waves at distant frequencies. The plate can, of course, be tuned to a wide enough band of sound frequencies to allow easy reception of the ordinary human voice.

Although this invention is directed primarily to a microphone, it is possible, with a piezoelectric element of large enough area, mounted for example to the wall of a house as a substrate, to apply external power to the claimed device and use it as a speaker.

I claim:

1. A surface-laminated piezoelectric-film sound transducer, comprising:

A. a thin film of piezoelectric material having two opposite faces,

B. two thin films of conductive material, one of said films of conductive material being affixed to one of said two opposite faces and another of said films of conductive material being affixed to another of said two opposite faces, thereby forming a piezoelectric sandwich element with the thin film of piezoelectric material in the middle and the two thin films of conductive material on the outside, C. a solid, flat, substantially inflexible substrate comprising a printed circuit board laminated to the piezoelectric sandwich element along substantially the entire surface of one of the two conductive layers, and D. two connecting conductors connected to the two films of conductive material for conducting an electrical signal between the piezoelectric sandwich element and some external point.

2. A surface-laminated piezoelectric-film sound transducer, comprising:

A. a thin film of piezoelectric material having two opposite faces,

B. two thin films of conductive material, one of said films of conductive material being affixed to one of said two opposite faces and another of said films of conductive material being affixed to another of said two opposite faces, thereby forming a piezoelectric sandwich element with the thin film of piezoelectric material in the middle and the two thin films of conductive-material on the outside, C. a solid, flat, substantially inflexible substrate laminated to the piezoelectric sandwich element along substantially the entire surface of one of the two conductive layers, D. two water-resistant protection layers sealed around the piezoelectric sandwich element and the substrate laminated thereto for protection against environmental moisture, and E. two connecting conductors connected to the two films of conductive material for conducting an electrical signal between the piezoelectric sandwich element and some external point.

3. A transducer according to claim 2, wherein the substrate is a printed circuit board.

4. A transducer according to claim 3, further comprising an impedance matching circuit connected to the two connecting conductors at a point between the two films of conducting material and said external point.

5. A transducer according to claim 4, wherein the impedance matching circuit is connected to allow use of the transducer as a microphone.

6. A transducer according to claim 6, wherein the piezoelectric sandwich element and the impedance matching element are shielded by a ground shield to protect against high electromagnetic interference.

7. A surface-laminated piezoelectric-film sound transducer, comprising:

A. a thin film of piezoelectric material having two opposite faces,

B. two thin films of conductive material, one of said films of conductive material being affixed to one of said two opposite faces and another of said films of conductive material being affixed to another of said two opposite faces, thereby forming a piezoelectric sandwich element with the thin film of piezoelectric material in the middle and the two thin films of conductive material on the outside, C. a solid, flat, substantially inflexible substrate laminated to the piezoelectric sandwich element along substantially the entire surface of one of the two conductive layers, D. two connecting conductors connected to the two films of conductive material for conducting an electrical signal between the piezoelectric sandwich element and some external point, E. means for protecting the piezoelectric sandwich element from the intrusion of ambient moisture, and F. means for holding the transducer in tight contact with the body of a living being, whereby the transducer operates as a microphone to pick up sounds made by said living being.

8. A surface-laminated piezoelectric-film sound transducer, comprising:

A. a thin film of piezoelectric material having two opposite faces,

B. two thin films of conductive material, one of said films of conductive material being affixed to one of said two opposite faces and another of said films of conductive material being affixed to another of said two opposite faces, thereby forming a piezoelectric sandwich element with the thin film of piezoelectric material in the middle and the two thin films of conductive material on the outside, C. a solid, flat, substantially inflexible substrate laminated to the piezoelectric sandwich element along substantially the entire surface of one of the two conductive layers, D. two connecting conductors connected to the two films of conductive material for conducting an electrical signal between the piezoelectric sandwich element and some external point, E. means for protecting the piezoelectric sandwich element from the intrusion of ambient moisture, and F. means for holding the transducer in a pressure field surrounding the mouth of a human speakers whereby the transducer operates as a microphone to pick up sounds made by said speaker.

9. A surface-laminated piezoelectric-film sound transducer, connected for use as a microphone, comprising:

A. a thin film of piezoelectric material having two opposite faces,

B. two thin films of conductive material, one of said films of conductive material being affixed to one of said two opposite faces and another of said films of conductive material being affixed to another of said two opposite faces, thereby forming a piezoelectric sandwich element with the thin film of piezoelectric material in the middle and the two thin films of conductive material on the outside, C. a solid, flat, substantially inflexible substrate formed of a printed circuit board laminated to the piezoelectric sandwich element along substantially the entire surface of one of the two conductive layers, D. two connecting conductors connected to the two films of conductive material for conducting an electrical signal between the piezoelectric sandwich element and some external point, E. two water-resistant protection layers sealed around the piezoelectric sandwich element and the substrate laminated thereto for protection of the piezoelectric sandwich element against environmental moisture, F. an impedance matching circuit connected to the two connecting conductors at a point between the two films of conducting material and said external point, and G. a ground shield to protect the piezoelectric sandwich element As and the impedance matching circuit from electromagnetic interference.

10. A surface-laminated piezoelectric-film sound transducer, comprising:

A. a thin film of piezoelectric material having two opposite faces,

B. two thin films of conductive material, one of said films of conductive material being affixed to one of said two opposite faces and another of said films of conductive material being affixed to another of said two opposite faces, thereby forming a piezoelectric sandwich element with the thin film of piezoelectric material in the middle and the two thin films of conductive material on the outside, C. a solid, flat, substantially inflexible substrate formed from a printed circuit board laminated to the piezoelectric sandwich element along substantially the entire surface of one of the two conductive layers, D. two connecting conductors connected to the two films of conductive material for conducting an electrical signal between the piezoelectric sandwich element and some external point.

E. two water-resistant protection elements sealed around the sandwich element and the substrate laminated thereto for protection against environmental damage F. an impedance matching circuit connected to the two connecting conductors at a point between the two films of conducting material and said external point, and G. a ground shield protecting the piezoelectric sandwich element and the impedance matching element against high electromagnetic interference.

* * * * *